United States Patent [19]

Manz et al.

[11] 4,017,061

[45] Apr. 12, 1977

[54] CONVEYOR TUBE FOR A PARTICULATE HEATING FURNACE

[75] Inventors: Vernon F. Manz, North Palm Beach; Robert A. Metcalfe, West Palm Beach, both of Fla.

[73] Assignee: United Technologies Corporation, Hartford, Conn.

[22] Filed: Dec. 4, 1975

[21] Appl. No.: 637,626

[52] U.S. Cl. ..... 266/173; 266/145

[51] Int. Cl.[2] ..... C21B 11/06

[58] Field of Search ..... 266/145, 173, 177, 901; 432/103, 108–114, 117–118; 13/21

[56] References Cited

UNITED STATES PATENTS

| | | | |
|---|---|---|---|
| 2,158,689 | 5/1939 | Buchanan | 432/112 |
| 2,412,133 | 12/1946 | Doyle | 432/118 |
| 2,446,637 | 8/1948 | Crampton et al. | 266/901 |
| 3,556,498 | 1/1971 | Sheahan | 432/118 |

FOREIGN PATENTS OR APPLICATIONS

| | | | |
|---|---|---|---|
| 505,901 | 1930 | Germany | 432/112 |
| 293,797 | 1916 | Germany | 432/112 |
| 699,448 | 1940 | Germany | 432/118 |
| 220,684 | 1924 | United Kingdom | 432/112 |

*Primary Examiner*—Gerald A. Dost
*Attorney, Agent, or Firm*—Charles A. Warren

[57] ABSTRACT

A conveyor tube construction for transporting particulate material as it passes through a furnace, the heating elements being a plurality of parallel radiant heating rods parallel to the conveyor tube and surrounding the tube in spaced relation to the tube and to each other. The tube has baffles on its inner surface to insure adequate tumbling so that the particulate material will be fully heated as it passes through the furnace.

3 Claims, 5 Drawing Figures

CONVEYOR TUBE FOR A PARTICULATE HEATING FURNACE

SUMMARY OF THE INVENTION

One feature of the invention is a conveyor tube arrangement for use in a furnace by which particulate material, carried by the conveyor tube may be heated and heat treated during its movement through the furnace. The heating system comprising a plurality of radiant heating rods parallel to the conveyor tube and spaced therefrom to form a cylindrical heating assembly surrounding the tube. The conveyor tube is heated by these rods and the material therein is also heated as it is transported through the furnace as the tube rotates. Baffles including a helical rib and axially extending ribs on the inside surface of the tube assure tumbling of the material and feeding of the material axially through the tube from one end of the furnace to the other.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

Figures 1, 2, 3, 4, 5:
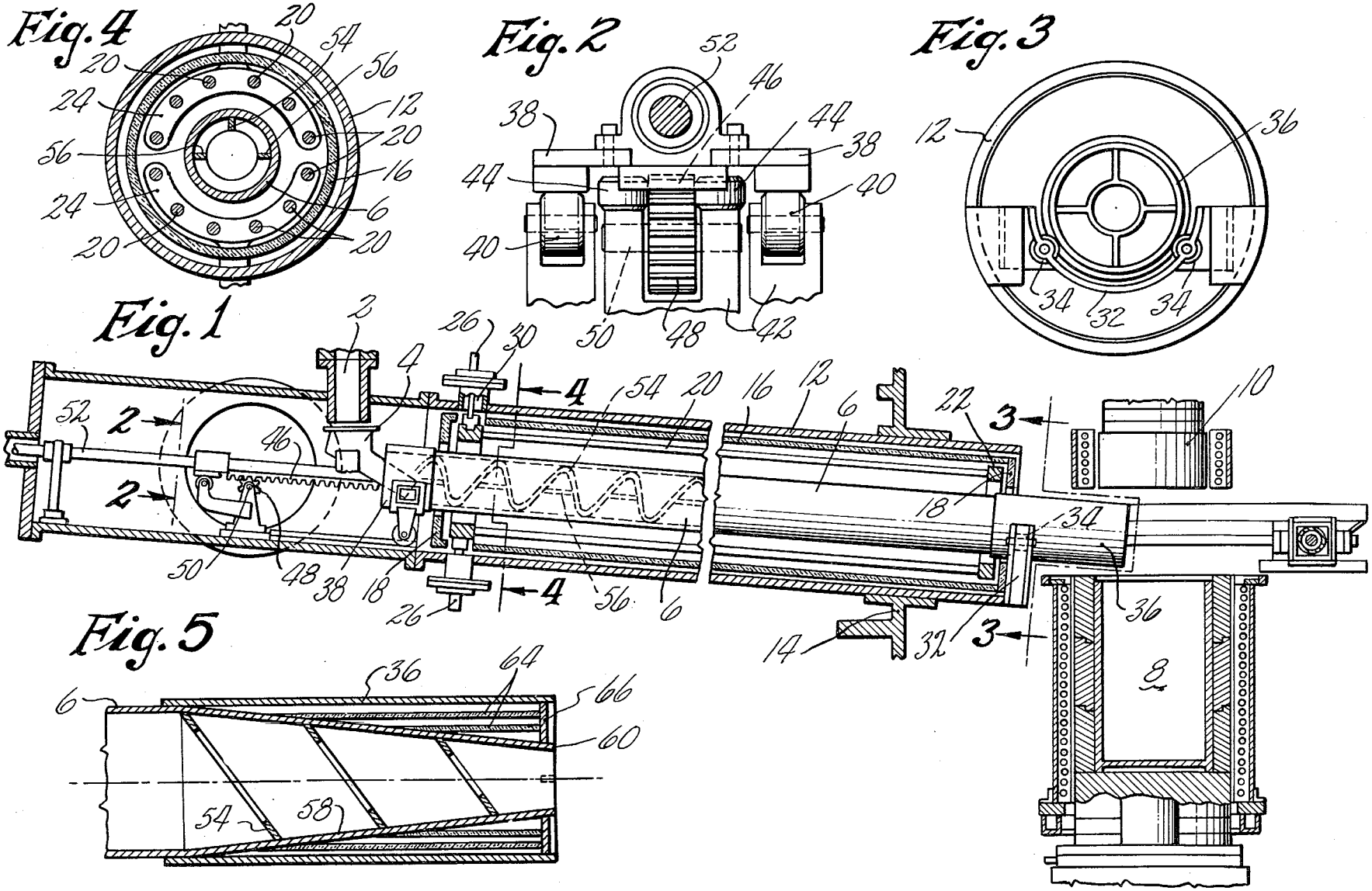
FIG. 1 is a vertical sectional view through a furnace embodying the invention.
FIG. 2 is a sectional view along line 2—2 of FIG. 1.
FIG. 3 is a sectional view along line 3—3 of FIG. 1.
FIG. 4 is a sectional view along line 4—4 of FIG. 1.
FIG. 5 is a fragmentary sectional view of the delivery end of the conveyor tube.

The invention is adapted for assuring adequate heating particulate matter as it is fed axially through the furnace by a rotating conveyor tube. A delivery spout 2 drops the particulate material into a funnel 4 which guides it into a conveyor tube 6. The tube extends axially through the furnace and by its rotation tumbles the material and transports it axially of the tube. The particulate matter is deposited from the discharge end of the tube 6 into a container 8 on a compacting press. The ram 10 of the press is intermittently moved down into the container for compacting the particulate material therein. The apparatus for delivering material to spout 2 and the press apparatus as such are described in the copending application of Jerry A. King et al., Ser. No. 637,624, filed Dec. 4, 1975 and having the same assignee as this application. The movement of the ram requires axial withdrawal of the end of the conveyor tube to avoid interference with the ram and the conveyor tube of this invention is constructed to permit this axial withdrawal as will be described.

The furnace includes an enclosure 12 in the form essentially of a cylinder having a tight fit with the spout 2 and also with the wall of an enclosure 14 for the press, only a part of this enclosure being shown. The arrangement is such that the enclosure may be evacuated so that the furnace as well as the press operate in a vacuum. In this construction one vacuum pump is used to evacuate the enclosure 12 at the inlet end of the tube and another vacuum pump evacuates the enclosure 14.

Within the enclosure 12 is a cylinder 16 of insulating material in closely spaced relation to the enclosure.

This cylinder has end caps 18 through which the opposite ends of the conveyor tube extend, there being clearance between the end caps and the tube so that it may move axially through the caps. The heating elements for the furnace are a plurality of electrically energized heating rods 20 such as, for example, carbon rods, extending parallel to and arranged in a cylinder around the conveyor tube, these rods being spaced substantially midway between the tube and the surrounding cylinder 16. These several rods 20 are all interconnected at one end by a conducting ring 22 surrounding the tube and spaced from both the tube and the adjacent end cap.

At the other ends of the rods they are interconnected in two groups by semi-circular connectors 24, half of the rings being secured to each connector as shown in FIG. 4. These connectors 24 are supported from the enclosure 12 as by conductive pins 26 extending inwardly through openings 28 in the enclosure. These pins are insulated from the openings 28 by dielectric sleeves 30. By connecting a power supply to the outer ends of the pins 26 power will pass through the heating rods to such a temperature as to radiate heat to the tube and thus heat the material within the conveyor tube as it moves axially through the furnace.

As above stated the furnace must serve to heat the material within the conveyor tube and is also constructed to permit axial movement of the tube. The particular mechanism for driving and moving the tube is described and claimed in the copending application of Donald G. MacNitt, Jr., Ser. No. 637,622, filed Dec. 4, 1975, having the same assignee as this application. For the purpose of the present invention it will be noted that the discharge end of the tube is supported on a yoke 32 having rollers 34 that permit the tube to rotate thereon but also permit an axial movement of the end cylindrical portion 36 of the tube past these rollers so long as the tube is rotating as the axial movement occurs.

The inlet end of the tube is supported on a carriage 38, FIG. 2, supported on rollers 40 on a bracket 42 on the enclosure. This bracket also has guide rollers 44 on vertical axes to maintain vertical alignment of a rack 46 on the carriage and a driving pinion 48 on the bracket. Power supplied to the pinion shaft 50 will move the carriage and thus the conveyor tube for axial withdrawal of the delivery end of the tube from interference with the ram 10. The tube itself is driven through a telescoping shaft 52. The funnel 4 is also mounted on the carriage to move with it. The carriage actuating structure and the tube driving mechanism are claimed in the copending application above identified, Ser. No. 637,622.

To convey the particulate material through the tube 6 for heating, the tube has a helical rib 54 on the inner surface, the helix being such that the material is moved toward the discharge end of the tube as the latter is rotated. In addition the furnace and the tube 6 are at an acute angle to the horizontal as shown with the discharge end being lower so that gravity helps in the axial movement of the particulate material. This helical rib causes some tumbling of the particulate material.

For further tumbling to assure complete heating of the particulate, axially extending short ribs 56 are mounted on the inner surface, preferably with about 180° angular spacing. These ribs extend between adjacent turns of the helical rib as shown. These ribs cause a significant tumbling of the material as they pass through the axial flow of the material by the rotation of the tube. It is essential that the particulate material all reach the desired temperature before reaching the delivery end of the furnace in order that the material be in the desired heat treated condition before delivery to the container.

Where the conveyor tube projects beyond the furnace during normal operation, the tube, which is otherwise cylindrical, has a convergent delivery portion 58 leaving a small diameter delivery end 60. The helical rib 54 is continued into this convergent portion as shown. Since this convergent portion is external to the furnace and receives no heat therefrom, the reduced surface area helps to conserve the heat in the particulate material therein. The cylindrical portion 36 surrounds the convergent portion and it is this portion 36 that engages the rollers 34 for support of the discharge end of the tube. To further minimize heat losses cylindrical heat shields 64 may surround the convergent portion as shown. These shields may be supported from an end cap 66 on the cylinder 36.

Another advantage of the convergent delivery portion with the small diameter delivery end is that it reduces the load on the vacuum pump for the press enclosure. The vacuum pump for the furnace enclosure at the inlet end of the tube serves also to remove the gaseous material given off from the particulate matter as it is degassed by heat when the material enters the furnace. The small diameter of the delivery end of the tube reduces the movement of gaseous material between the separately evacuated vacuum chambers.

One form of particulate material that is used because of its uniformity of heating is made by lathe turning of an ingot or billet, in which the depth of cut is uniform for the material and the rate of tool feed is constant to produce the desired thickness in the chips. These chips are thus all of the same thickness and generally of the same width (the depth of cut). Since these chips are the particulate material the uniform thickness will assure a complete heating of all the individual particles in the same time period. Thus if the depth of cut is one-eighth inch and the tool feed is 0.010 inch per revolution, the particles will substantially all be 0.010 inch in thickness and about ⅛ inch in width. The length of the particles may be controlled by suitable chip-breakers on the cutting tool. Although such particulate matter is not essential, it assures effective heating of the particulate material.

Where the containerized material is superplasticized during passage through the furnace it is found that if the material is heated to 1800° F in the furnace it will be recrystallized to make it superplastic. In this way the containerized material may be used in subsequent forming operations where the superplastic state makes possible such forming. Thus when used this way the furnace temperature is somewhat above 1800° F, for example between 1900° F and 2100° F to assure the complete heating of the material to the required temperature in the time that it is moving through the furnace.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of our invention, that which we claim as new and desire to secure by Letters Patent of the United States is:

1. A furnace for heating particulate material including:

a cylindrical housing, a cylindrical insulator within and spaced from the housing and end caps with openings therein, a heater in the form of a plurality of resistance heating rods parallel to the cylindrical insulator and within the insulator and supported from the surrounding cylindrical housing, said rods forming a cylinder located concentrically within the insulator, a rotary tube concentrically within the heating cylinder for conveying particulate material through the heater, said tube having a helical rib internally for translating material axially through the tube and spaced axially extending ribs internally of the tube to cause tumbling of the material within the tube, said tube extending through the openings in the insulating end caps, and the several cylinders being positioned at an acute angle to the horizontal to increase the axial rate of travel of the particulate material through a tube.

2. A furnace as in claim 1 in which the tube has a converging delivery end extending beyond the end of the furnace and a cylindrical sleeve surrounding the delivery end and on which the delivery end is supported.

3. A furnace as in claim 2 in which the convergent end is surrounded by a cylindrical heat shield within the cylindrical sleeve to minimize heat loss from the particulate material in the convergent end.

* * * * *